United States Patent [19]

Mozer et al.

[11] 4,384,169

[45] May 17, 1983

[54] METHOD AND APPARATUS FOR SPEECH SYNTHESIZING

[75] Inventors: Forrest S. Mozer, 38 Sumerset Pl., Berkeley, Calif. 94707; Richard P. Stauduhar, Berkeley, Calif.

[73] Assignee: Forrest S. Mozer, Berkeley, Calif.

[21] Appl. No.: 88,790

[22] Filed: Oct. 29, 1979

Related U.S. Application Data

[60] Division of Ser. No. 761,210, Jan. 21, 1977, Pat. No. 4,214,125, which is a continuation of Ser. No. 632,140, Nov. 14, 1975, abandoned, which is a continuation-in-part of Ser. No. 525,388, Nov. 20, 1974, abandoned, which is a continuation-in-part of Ser. No. 432,859, Jan. 14, 1974, abandoned.

[51] Int. Cl.[3] ..... G10L 1/00

[52] U.S. Cl. ..... 179/1 SM

[58] Field of Search ..... 179/1 SM, 1 SA, 1 SG, 179/15.55 R, 15.55 T; 358/260, 261; 84/1.01, 1.03; 375/27, 28; 455/72; 340/347 DD, 148

[56] References Cited

U.S. PATENT DOCUMENTS

| | | | |
|---|---|---|---|
| 3,378,641 | 4/1968 | Varsos et al. | 179/15.55 R |
| 3,553,362 | 1/1971 | Mounts | 358/261 |
| 3,575,555 | 4/1971 | Schanne | 179/1 SM |
| 3,588,353 | 6/1971 | Martin | 179/1 SM |
| 3,641,496 | 2/1972 | Slavin | 179/1 SM |
| 3,723,879 | 3/1973 | Kaul et al. | 179/15.55 R |
| 3,750,024 | 7/1973 | Dunn et al. | 179/15.55 R |
| 3,789,144 | 1/1974 | Doyle | 179/15.55 T |
| 3,952,164 | 4/1976 | David et al. | 179/1 SA |

OTHER PUBLICATIONS

Hellwarth et al., "Automatic Conditioning of Speech Signals," IEEE Trans., Audio etc., Jun. 1968, pp. 169–179.

*Primary Examiner*—Emanuel S. Kemeny

*Attorney, Agent, or Firm*—Townsend and Townsend

[57] ABSTRACT

A method and apparatus for analyzing and synthesizing speech information in which a predetermined vocabulary is spoken into a microphone, the resulting electrical signals are differentiated with respect to time, digitized, and the digitized waveform is appropriately expanded or contracted by linear interpolation so that the pitch periods of all such waveforms have a uniform number of digitizations and the amplitudes are normalized with respect to a reference signal. These "standardized" speech information digital signals are then compressed in the computer by subjectively removing preselected relatively low power portions of the signals by a process termed "X period zeroing" and by discarding redundant speech information such as redundant pitch periods, portions of pitch periods, redundant phonemes and portions of phonemes, redundant amplitude information (delta modulation) and phase information (Fourier transformation). The compression techniques are selectively applied to certain of the speech information signals by listening to the reproduced, compressed information. The resulting compressed digital information and associated compression instruction signals produced in the computer are thereafter injected into the digital memories of a digital speech synthesizer where they can be selectively retrieved and audibly reproduced to recreate the original vocabulary words and sentences from them.

69 Claims, 8 Drawing Figures

METHOD AND APPARATUS FOR SPEECH SYNTHESIZING

CROSS-REFERENCES TO RELATED APPLICATIONS

This application is a divisional of co-pending application Ser. No. 761,210, filed Jan. 21, 1977 entitled "METHOD AND APPARATUS FOR SPEECH SYNTHESIZING," which is a continuation of application Ser. No. 632,140, filed Nov. 14, 1975 entitled "METHOD AND APPARATUS FOR SPEECH SYNTHESIZING," now abandoned, which is a continuation-in-part of application Ser. No. 525,388, filed Nov. 20, 1974, entitled "METHOD AND APPARATUS FOR SPEECH SYNTHESIZING," now abandoned, which, in turn, is a continuation-in-part of application Ser. No. 432,859, filed Jan. 14, 1974, entitled "METHOD FOR SYNTHESIZING SPEECH AND OTHER COMPLEX WAVEFORMS," which was abandoned in favor of application Ser. No. 525,388.

INCORPORATION BY REFERENCE

The entire disclosure of commonly owned, allowed co-pending application Ser. No. 761,210, filed Jan. 21, 1977 entitled "METHOD AND APPARATUS FOR SPEECH SYNTHESIZING" now U.S. Pat. No. 4,214,125 issued July 22, 1980 is hereby incorporated by reference.

FIELD OF THE INVENTION

The present invention relates to speech synthesis and more particularly to a method for analyzing and synthesizing speech and other complex waveforms using basically digital techniques.

SUMMARY OF THE INVENTION

In its broadest aspect, the invention comprises the technique termed "X period zeroing" which comprises the steps of deleting preselected relatively low power fractional portions of the input information signals and generating instruction signals specifying those portions of the signals so deleted which are to be later replaced during synthesis by a constant amplitude signal of predetermined value, the term "X" corresponding to a fractional portion of the signal thus compressed. The X period zeroing technique by itself produces information compression by a factor of two for $X=\frac{1}{2}$; however, this technique is combined with the following compression techniques to provide even greater compression. The term "phase adjusting"—also designated Mozer phase adjusting—comprises the steps of Fourier transforming a periodic time signal to derive frequency components whose phases are adjusted such that the resulting inverse Fourier transform is a time-symmetric pitch period waveform whereby one-half of the original pitch period is made redundant. The technique termed "phoneme blending" comprises the step of storing portions of input signals corresponding to selected phonemes and phoneme groups according to their ability to blend naturally with any other phoneme. The technique termed "pitch period repetition" comprises the steps of selecting signals representative of certain phonemes and phoneme groups from information input signals and storing only portions of these selected signals corresponding to every nth pitch period of the wave form while storing instruction signals specifying which phonemes and phoneme groups have been so selected and the value of n. The technique termed "multiple use of syllables" comprises the step of separating signals representative of spoken words into two or more parts, with such parts of later words that are identical to parts of earlier words being deleted from storage in a memory while instruction signals specifying which parts are deleted are also stored. The technique termed "floating zero, two-bit delta modulation" comprises the steps of delta modulating digital signals corresponding to information input signals prior to storage in a first memory by setting the value of the ith digitization of the sampled signal equal to the value of the $(i-1)$th digitization of the sampled signals plus $f(\Delta_{i-1}, \Delta_i)$ where $f(\Delta_{i-1}, \Delta_i)$ is an arbitrary function having the property in a specification embodiment that changes of wave form of less than two levels from one digitization to the next are reproduced exactly while greater changes in either direction are accommodated by slewing in either direction by three levels per digitization. Preferably, the phase adjusting technique includes the step of selecting the representative symmetric wave form which has a minimum amount of power in one-half of the period being analyzed (for $X=\frac{1}{2}$)". and which possesses the property that the difference between amplitudes of successive digitizations during the other half period of the selected wave form are consistent with possible values obtainable from the delta modulation step. The techniques, in addition to taking the time derivative and time quantizing the signal information, involve discarding portions of the complex waveform within each period of the waveform, e.g. a portion of the pitch period where the waveform represents speech and multiple repetitions of selected waveform periods while discarding other periods. In the case of speech waveforms, the presence of certain phonemes are detected and/or generated and are multiply repeated as are syllables formed of certain phonemes. Furthermore, certain of the speech information is selectively delta modulated according to an arbitrary function, to be described, which allows a compression factor of approximately two while preserving a large amount of speech intelligibility.

In contrast to the goals of earlier speech synthesis research to reproduce an unlimited vocabulary, the present invention has resulted from the desire to develop a speech synthesizer having a limited vocabulary on the order of one hundred words but with a physical size of less than about 0.25 inches square. This extremely small physical size is achieved by utilizing only digital techniques in the synthesis and by building the resulting circuit on a single LSI (large scale integration) electronic chip of a type that is well known in the fabrication of electronic calculators or digital watches. These goals have precluded the use of vocoder technology and resulted in the development of a synthesizer from wholly new concepts. By uniquely combining the above mentioned, newly developed compression techniques with known compression techniques, the method of the present invention is able to compress information sufficient for such multi-word vocabulary onto a single LSI chip without significantly compromising the intelligibility of the original information.

The uses for compact synthesizers produced in accordance with the invention are legion. For instance, such a device can serve in an electronic calculator as a means for providing audible results to the operator without requiring that he shift his eyes from his work. Or it can be used to provide numbers in other situations where it is difficult to read a meter. For example, upon demand it could tell a driver the speed of his car, it could tell an electronic technician the voltage at some point in his circuit, it could tell a precision machine operator the information he needs to continue his work, etc. It can also be used in place of a visual readout for an electronic timepiece. Or it could be used to give verbal messages under certain conditions. For example, it could tell an automobile driver that his emergency brake is on, or that his seatbelt should be fastened, etc. Or it could be used for communication between a computer and man, or as an interface between the operator and any mechanism, such as a pushbutton telephone, elevator, dishwasher, etc. Or it could be used in novelty devices or in toys such as talking dolls.

The above, of course, are just a few examples of the demand for compact units. The prior art has not been able to fill this demand, because presently available, unlimited vocabulary speech synthesizers are too large, complex and costly. The invention, hereinafter to be described in greater detail, provides a method and apparatus for relatively simple and inexpensive speech synthesis which, in the preferred embodiment, uses basically digital techniques.

It is therefore an object of the present invention to provide a method for synthesizing speech from which a compact speech synthesizer can be fabricated.

It is another object of the present invention to provide a method for synthesizing speech using only one or a few LSI or equivalent electronic chips each having linear dimensions of approximately ¼ inch on a side.

It is still another object of the invention to provide a method for synthesizing speech using basically digital rather than analog techniques.

It is a further object of the present invention to provide a method for synthesizing speech in which the information content of the phoneme waveform is compressed by storing only selected portions of that waveform.

Yet a further object of the present invention is to provide a method for synthesizing speech which allows a speech synthesizer to be manufactured at low cost.

The foregoing and other objectives, features and advantages of the invention will be more readily understood upon consideration of the following detailed description of certain preferred embodiments of the invention, taken in conjunction with the accompanying drawings.

FIGS. *7a–7c* represent, respectively, digitized periods of speech before phase adjusting, after phase adjusting, and after half period zeroing and delta-modulation, while FIG. *7d* is a composite curve resulting from the superimposition of the curve of FIGS. *7b* and *7c;*

Figure 9:
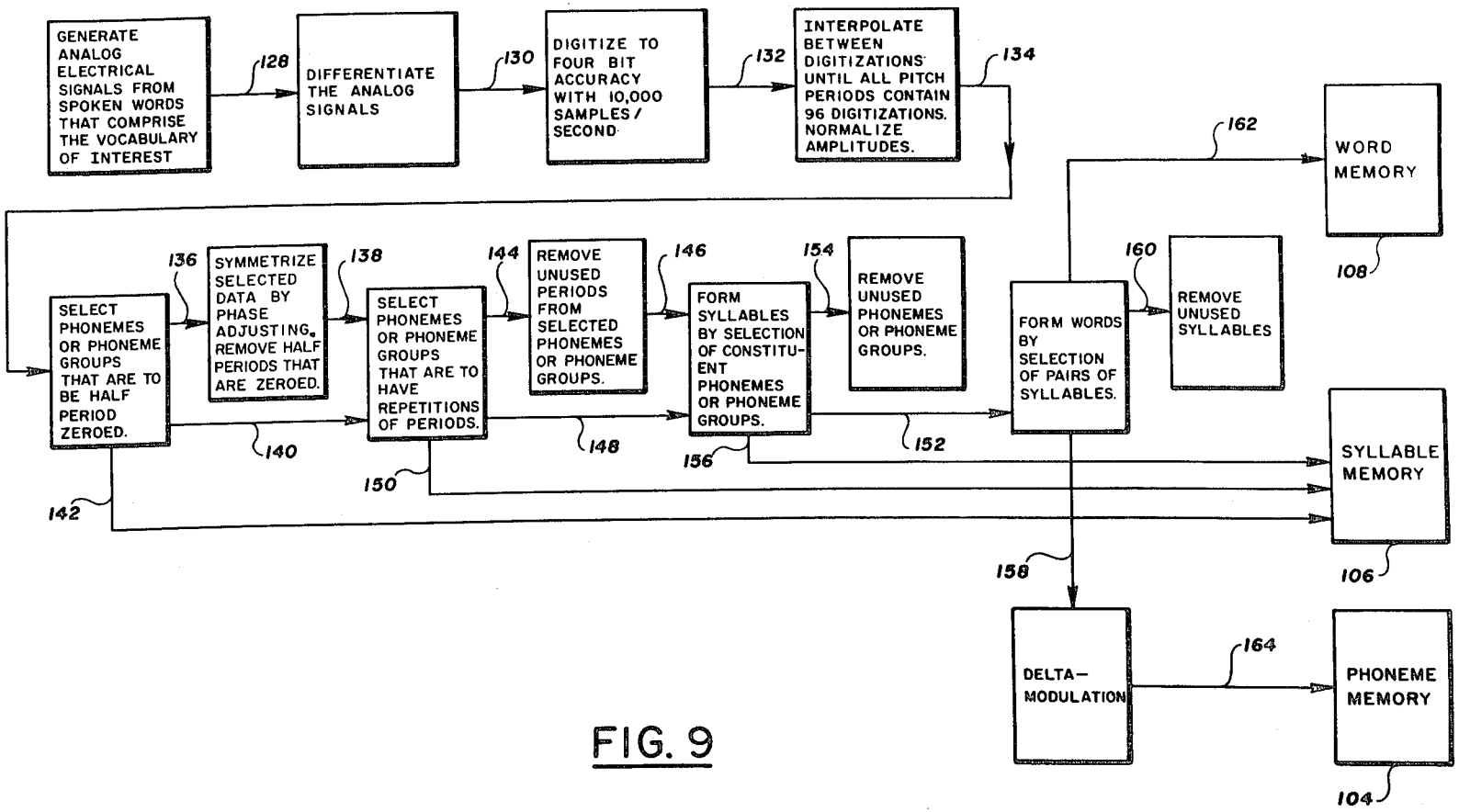
Figure 10:
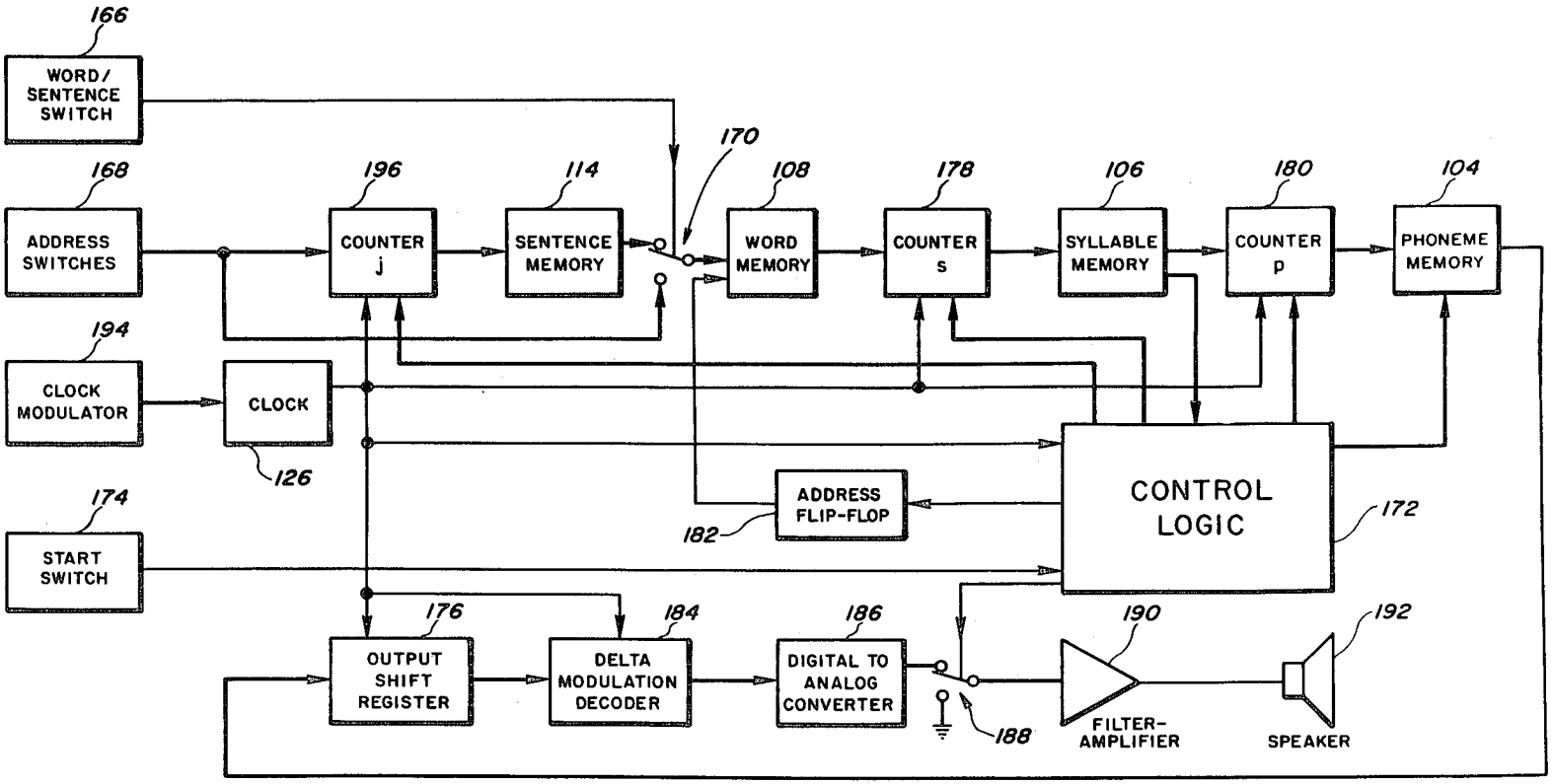

FIG. 9 is a block diagram illustrating the methods of analysis for generating the information in the phoneme, syllable, and word memories of the speech synthesizer according to the invention; and FIG. 10 is a block diagram of the synthesizer electronics of the preferred embodiment of the invention.

The preferred embodiment of this invention may be best understood by reference to FIGS. 5–7, 9 and 10 in connection with the following description, and also with reference to the more expanded detailed description contained in the referenced U.S. Pat. No. 4,214,125. The following Table illustrates a representative vocabulary stored in a synthesizer in accordance with the invention.

DETAILED DESCRIPTION OF CERTAIN PREFERRED EMBODIMENTS

TABLE 2

| Vocabulary of the Speech Synthesizer | | |
|---|---|---|
| The numbers "0"–"99", inclusive; | | |
| "plus", | "minus", | "times", |
| "over", | "equals", | "point", |
| "overflow", | "volts", | "ohms", |
| "amps", | "dc", | "ac", |
| "and", | "seconds", | "down", |
| "up", | "left", | "pounds", |
| "ounces", | "dollars", | "cents", |
| "centimeters", | "meters", | "miles", |
| "miles per hour", | a short period of silence, and | a long period of silence |

Figure 5:
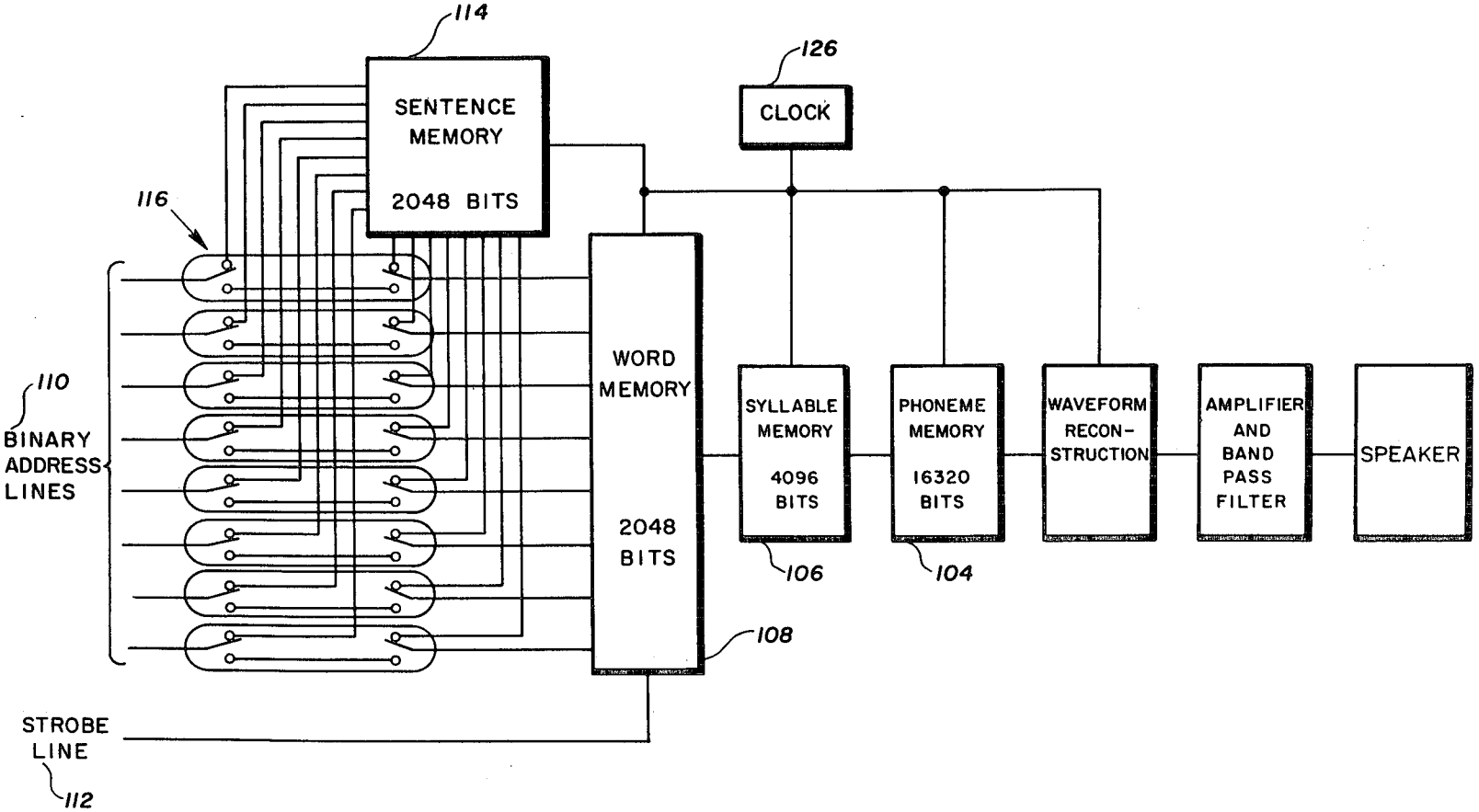
FIG. 5 is a simplified block diagram of a speech synthesizer illustrating the storage and retrieval method of the present invention.

A block diagram of the preferred embodiment of the speech synthesizer 103 according to the invention is given in FIG. 5. It should be understood, however, that the initial programming of the elements of this block diagram by means of a human operator and a digital computer will be discussed in detail in reference to FIG. 9. The synthesizer phoneme memory 104 stores the digital information pertinent to the compressed waveforms and contains 16,320 bits of information. The synthesizer syllable memory 106 contains information signals as to the locations in the phoneme memory 104 of the compressed waveforms of interest to the particular sound being produced and it also provides needed information for the reconstruction of speech from the compressed information in the phoneme memory 104. Its size is 4096 bits. The synthesizer word memory 108, whose size is 2048 bits, contains signals representing the locations in the syllable memory 106 of information signals for the phoneme memory 104 which construct syllables that make up the word of interest.

To recreate the compressed speech information stored in the speech synthesizer a word is selected by impressing a predetermined binary address on the seven address lines 110. This word is then constructed electronically when the strobe line 112 is electrically pulsed by utilizing the information in the word memory 108 to locate the addresses of the syllable information in the syllable memory 106, and in turn, using this information to locate the address of the compressed waveforms in the phoneme memory 104 and to ultimately reconstruct the speech waveform from the compressed data and the reconstruction instructions stored in the syllable memory 106. The digital output from the phoneme memory 104 is passed to a delta-modulation decoder circuit 184 and thence through an amplifier 190 to a speaker 192. The diagram of FIG. 5 is intended only as illustrative of the basic functions of the synthesizer portion of the invention; a more detailed description is given in reference to FIGS. 10 and 11*a*–11*f* in the referenced U.S. Pat. No. 4,214,125.

Groups of words may be combined together to form sentences in the speech synthesizer through addressing a 2048 bit sentence memory 114 from a plurality of external address lines 110 by positioning seven, double-pole double-throw switches 116 electronically into the configuration illustrated in FIG. 5.

The selected contents of the sentence memory 114 then provide addresses of words to the word memory 108. In this way, the synthesizer is capable of counting from 1 to 40 and can also be operated to selectively say such things as: "3.5+7−6=4.5," "1942 over 0.0001=overflow," "2×4=8," "4.2 volts dc," "93 ohms," "17 amps ac," "11:37 and 40 seconds, 11:37 and 50 seconds," "3 up, 2 left, 4 down," "6 pounds 15 ounces equals 8 dollars and 76 cents," "55 miles per hour," and "2 miles equals 3218 meters, equals 321869 centimeters," for example.

Compression Techniques

As described above, the basic content of the memories 108, 106 and 104 is the end result of certain speech compression techniques subjectively applied by a human operator to digital speech information stored in a computer memory. The theories of these techniques will now be discussed. In actual practice, certain basic speech information necessary to produce the one hundred and twenty-eight word vocabulary is spoken by the human operator into a microphone, in a nearly monotone voice, to produce analog electrical signals representative of the basic speech information. These analog signals are next differentiated with respect to time. This information is then stored in a computer and is selectively retrieved by the human operator as the speech programming of the speech synthesizer circuit takes place by the transfer of the compressed data from the computer to the synthesizer. This process is explained in greater detail in the referenced U.S. Pat. No. 4,214,125 in reference to FIG. 9.

X-Period Zeroing

Figure 6:
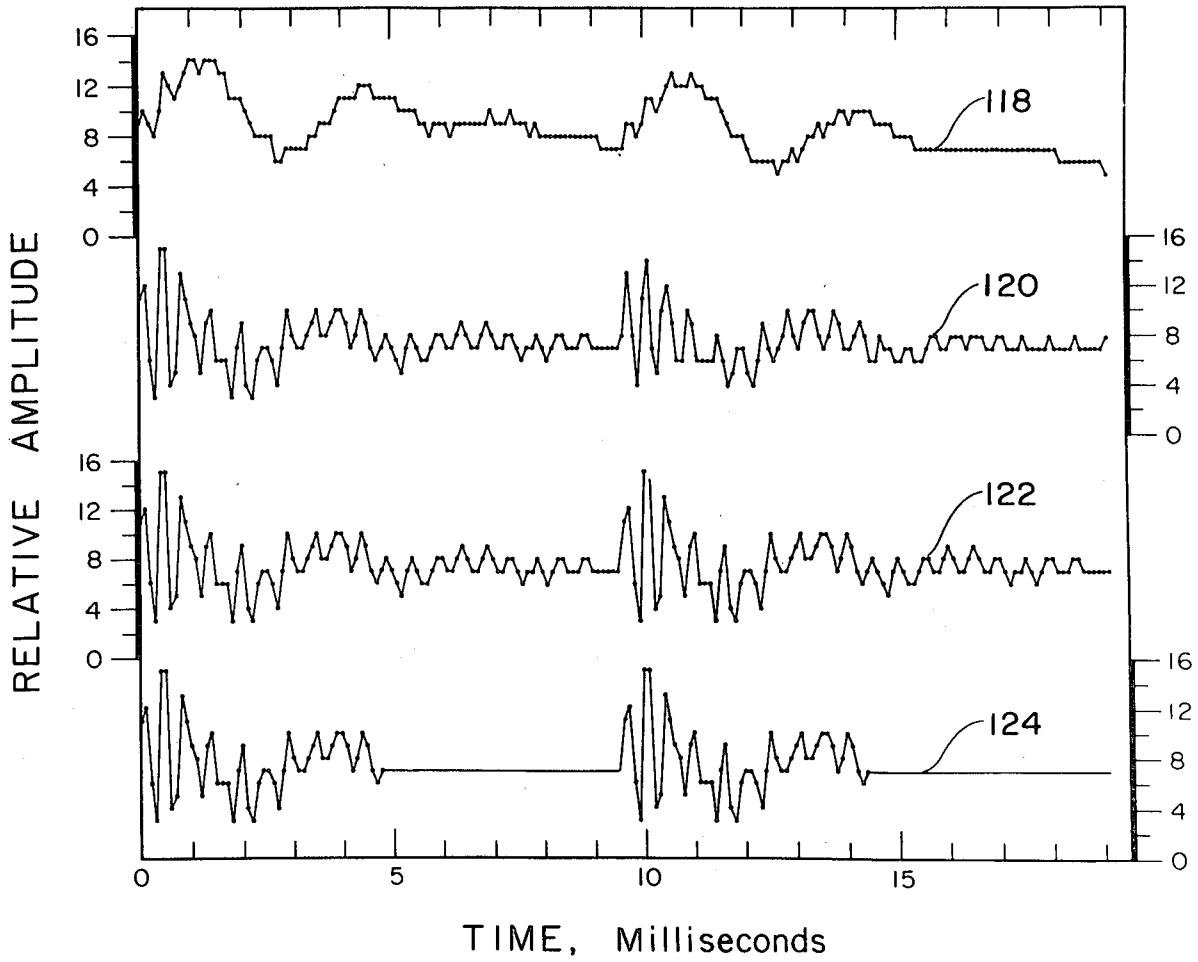
FIG. 6 is an illustrative waveform graph which contains two pitch periods of the phoneme /i/ plotted in order from top to bottom in the figure, as a function of time before differentiation of the waveform, after differentiation of the waveform, after differentiation and replacing the second pitch period by a repetition of the first, and after differentiation, replacing the second pitch period by a repetition of the first, and half-period zeroing.
Figures 7A, 7B, 7C, 7D:
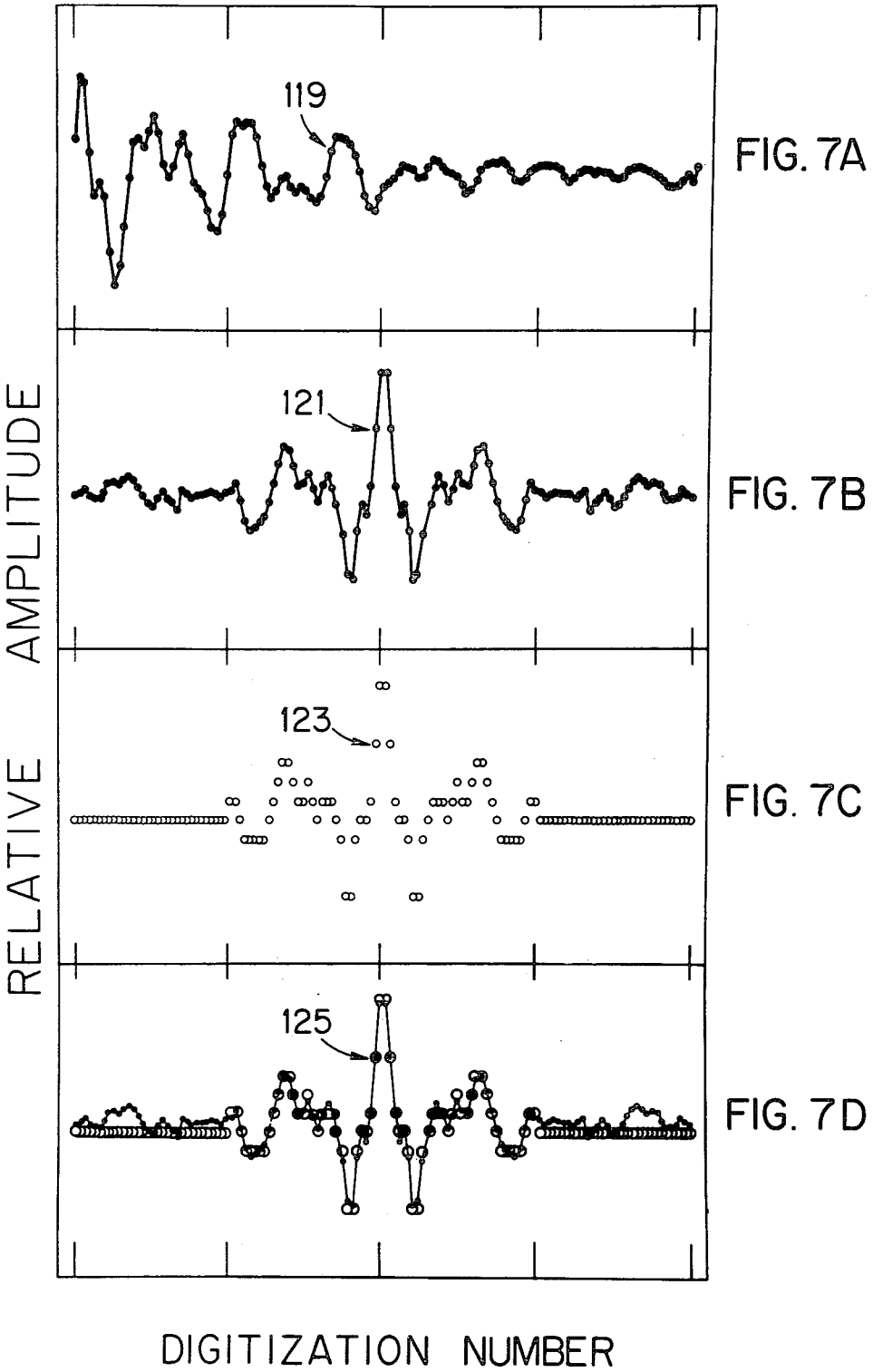

According to this invention, the fundamental technique for decreasing the information content in a speech waveform without degrading its intelligibility or quality is referred to herein as "x-period zeroing." To understand this technique, reference must be made to a speech waveform such as 122 in FIG. 6. It is seen that most of the amplitude or energy in the waveform is contained in the first part of each pitch period. Since this observation is typical of most phonemes, it is possible to delete the last portion of the waveform within each pitch period without noticeably degrading the intelligibility or quality of voiced phonemes.

An example of this technique is illustrated as the lowermost waveform of FIG. 6 in which the small amplitude half 124 of each pitch period of the waveform 122 has been set equal to zero. This is easily done in the computer because of the fact that the pitch periods of all of the different phonemes are previously made uniform. This $\frac{1}{2}$-period zeroed waveform 124 sounds indistinguishable from that of 122 even though its information content is smaller by a factor of two. Experiments have been performed in a computer in which fractions from one-fourth to three-fourths of the waveform within each pitch period of the voiced phonemes were replaced by a constant amplitude signal by use of conventional techniques for manipulating data in the computer memory. These experiments, called "x-period zeroing" with x between $\frac{1}{4}$ and $\frac{3}{4}$, produced words that were indistinguishable from the original for x less than about 0.6. For $x=\frac{3}{4}$, the words were mushy sounding although highly intelligible. In the speech synthesizer of the preferred embodiment of the invention, x has been chosen as $\frac{1}{2}$ for the voiced phonemes or phoneme groups, however, in other, less advantageous embodiments of the invention, x can be in the range of $\frac{1}{4}$ to $\frac{3}{4}$.

Because this technique introduces power at the pitch frequency, it cannot be used on unvoiced sounds which have insufficient amplitude at such frequencies to mask this distortion. Since about 80% of the phonemes in the prototype speech synthesizer are half-period zeroed, a compression factor of about 1.8 has been achieved in the prototype speech synthesizer by application of the technique of half-period zeroing.

Implementation of half-period zeroing in the speech synthesizer is made relatively simple by the fact that all pitch periods are of equal length. Information initially generated by the human operator on whether a given phoneme or phoneme group is half-period zeroed is carried by a single bit in the syllable memory 106. The output analog waveform of phonemes that are half-period zeroed is replaced by a constant level signal during the last half 124 of each pitch period by switching the output from the analog waveform to a constant level signal. The half-period zeroing bit in the syllable memory 106 is also used to indicate application of the compression technique of "phase adjusting." This technique interacts with x-period zeroing to diminish the degradation of intelligibility associated with x-period zeroing, in a manner that is discussed with particularity in the referenced parent application.

The technique of introducing silence into the waveform is also used in many other places in the speech synthesizer. Many words have soundless spaces of about 50–100 milliseconds between phonemes. For example, the word "eight" contains a space between the two phonemes /e/ and /t/. Similarly, silent intervals often exist between words in sentences. These types of silence are produced in the synthesizer by switching its output from the speech waveform to the constant level when the appropriate bit of information in the syllable memory indicates that the phoneme of interest is silence.

OTHER COMPRESSION TECHNIQUES

As noted above, the "X period zeroing" technique can be used in combination with other compression techniques to produce information compression of a magnitude substantially greater than the factor of 2 provided by this basic technique (for $X=\frac{1}{2}$). More specifically, these additional compression techniques, which are discussed in detail in the referenced U.S. Pat. No. 4,214,125, are differentiation of the original input wave form, digitization of either the original analog signals or the differentiated versions thereof, multiple use of phonemes or phoneme groups in constructing words, multiple use of syllables, repetition of pitch periods of sound, delta-modulation, particularly floating-zero, two-bit delta modulation, Mozer phase adjusting, pitch frequency variations, and amplitude variations.

To summarize the process by which the data for the synthesizer memories is generated in the computer, reference is made in particular to FIG. 9. The vocabulary of Table 2 is first spoken into a microphone whose output 128 is differentiated by a conventional electronic RC circuit to produce a signal that is digitized to 8-bit accuracy at a digitization rate of 10,000 samples/second by a commercially available analog to digital converter. This digitized waveform signal 132 is stored in the memory of a computer 133 where the signal 132 is expanded or contracted by linear interpolation between successive data points until each pitch period of voiced speech contains 96 digitizations using straight-forward computer software. The amplitude of each word is then normalized by computer comparison to the amplitude of a reference phoneme to produce a signal having a waveform 134. See the discussion in the referenced U.S. Pat. No. 4,214,125 for a more complete description of these steps.

The phonemes or phoneme groups in this waveform that are to be half-period zeroed and phase adjusted are next selected by listening to the resulting speech, and these selected waveforms 136 are phase adjusted and half-period zeroed using conventional computer memory manipulation techniques and sub-routines to produce waveforms 138. See the referenced U.S. Pat. No. 4,214,125 for a more complete description of these steps. The waveforms 140 that are chosen by the operator to not be half-period zeroed are left unchanged for the next compression stage while the information 142 concerning which phonemes or phoneme groups are half-period zeroed and phase adjusted is entered into the syllable memory 106 of the synthesizer 103.

The phoneme or phoneme groups 144 having pitch periods that are to be repeated are next selected by listening to the resulting speech which is reproduced by the computer and their unused pitch periods (that are replaced by the repetitions of the used pitch periods in reconstructing the speech waveform) are removed from the computer memory to produce waveforms 146. Those phoneme or phoneme groups 148 chosen by the operator to not have repeated periods by-pass this operation and the information 150 on the number of pitch-period repetitions required for each phoneme or phoneme group becomes part of the data transferred to the synthesizer syllable memory 106. See the discussion in the referenced U.S. Pat. No. 4,214,125 for a more complete description of these steps.

Syllables are next constructed from selected phonemes or phoneme groups 152 by listening to the resulting speech and by discarding the unused phonemes or phoneme groups 154. The information 156 on the phonemes or phoneme groups comprising each syllable become part of the synthesizer syllable memory 106. Words are next subjectively constructed from the selected syllables 158 by listening to the resulting speech, and the unused syllables 160 are discarded from the computer memory. The information 162 on the syllable pairs comprising each word is stored in the synthesizer word memory 108. See the referenced U.S. Pat. No. 4,214,125 for a more complete description of these steps. The information 158 then undergoes delta modulation within the computer to decrease the number of bits per digitization from four to two. The digital data 164, which is the fully compressed version of the initial speech, is transferred from the computer and is stored as the contents of the synthesizer phoneme memory 104.

The content of the synthesizer sentence memory 114, which is shown in FIG. 5 but is not shown in FIG. 9 to simplify the diagram, is next constructed by selecting sentences from combinations of the one hundred and twenty-eight possible words of Table 2. The locations in the word memory 108 of each word in the sequence of words comprising each sentence becomes the information stored in the synthesizer sentence memory 114. See the discussion in the referenced U.S. Pat. No. 4,214,125 for a more complete description of the phoneme, syllable and word memories.

A block diagram of the synthesizer is illustrated in FIG. 10. A detailed description of the functional operation of the synthesizer is contained in the referenced U.S. Pat. No. 4,214,125.

The terms and expressions which have been employed here are used as terms of description and not of limitations, and there is no intention, in the use of such terms and expressions, of excluding equivalents of the features shown and described, or portions thereof, it being recognized that various modifications are possible within the scope of the invention claims.

What is claimed is:

1. A method of X period zeroing information bearing signals to reduce the information content thereof without destroying the intelligibility thereof, said method comprising the steps of:

(a) deleting preselected relatively low power portions of said signals irrespective of the polarity thereof; and (b) generating instruction signals specifying those portions of said signals deleted in step (a) to be later replaced by a constant amplitude signal of predetermined value when synthesizing said information bearing signals, the value of each said constant amplitude signal lying between the maximum and minimum values of the corresponding deleted portion of the information bearing signal.

2. The method of claim 1 wherein said signals are essentially periodic and wherein said preselected portions lie in the range from about $\frac{1}{4}$ to about $\frac{3}{4}$ of the period.

3. The method of claim 2 wherein said signals are speech signals and wherein said period comprises the pitch period of said speech signals.

4. The method of claim 2 wherein said preselected portion is substantially $\frac{1}{2}$.

5. The method of claim 1 further including the step of time quantizing said signals before said step (a) of deleting.

6. The method of claim 1 further including the step of time quantizing said signals after said step (a) of deleting.

7. The method of claim 1 further including the step of time differentiating said signals prior to said step (a) of deleting.

8. The method of claim 1 further including the step of time differentiating said signals after said step (a) of deleting.

9. The method of claim 1 wherein said step (a) of deleting includes the step of selecting signals representative of particular phonemes and phoneme groups for deletion, said preselected portions corresponding to parts or all of the pitch periods of said particular phonemes and phoneme groups, and wherein said step (b) of generating includes the step of generating additional instruction signals identifying the phonemes and phoneme groups so selected.

10. The method of claim 1 wherein said information bearing signals are audio signals having phonemes and phoneme groups and wherein said step (a) of deleting includes the step of deleting preselected signals representative of portions of particular phonemes and phoneme groups from said audio signals, said preselected signals corresponding to those portions lying between every nth pitch period of said particular phonemes and phoneme groups; and wherein said step (b) of generating includes the step of generating additional instruction signals specifying said particular phonemes and phoneme groups and identifying the corresponding values of n.

11. The method of claim 1 wherein said step (a) of deleting includes the step of separating said signals into at least two parts and deleting parts occurring later in time which are substantially identical to parts occurring earlier in time; and wherein said step (b) of generating includes the step of generating further instruction signals specifying those parts so deleted.

12. The method of claim 1 further including the step of delta-modulating the signals resulting from said step (a) of deleting.

13. The method of claim 1 further including the step (c) of storing in a memory device said signals resulting from said step (b) and said instruction signals.

14. The method of claim 13 wherein said step (c) of storing is preceded by the step of converting to digital signals said signals resulting from said step (a) of deleting.

15. The method of claim 13 wherein said information bearing signals are speech signals and wherein said step (c) of storing includes the step of storing portions of said signals corresponding to selected phonemes and phoneme groups according to their ability to blend naturally with any other phenome.

16. A method of synthesizing signals from information signals previously compressed from original signals by the technique of X period zeroing said original signals by deleting predetermined relatively low-power information bearing portions therefrom and having non-deleted portions, and instruction signals identifying those portions of the compressed information signals where deletion has occurred, said method comprising the steps of:

(a) reproducing said compressed information signals;

(b) inserting substantially constant amplitude signals between said non-deleted portions of said compressed information signals in accordance with said instruction signals, each said substantially constant amplitude signal having a single value lying between the maximum and minimum values of the corresponding deleted portion of the original signal, so that said deleted relatively low-power signal portions are replaced by said signals of substantially constant amplitude; and (c) converting the signals resulting from step (b) to audible form.

17. The method of claim 16 wherein said compressed signals are stored in a memory device and wherein said step (a) of reproducing includes the step of reading said signals from said memory device.

18. The method of claim 17 wherein said compressed signals are stored in said memory device in digital form and wherein said step (a) of reproducing includes the step of converting said digital signals to analog signals.

19. The method of claim 16 wherein said compressed information signals are delta-modulated signals and wherein said step (a) of reproducing includes the step of delta-modulation decoding said compressed information signals.

20. The method of claim 16 wherin said compressed information signals represent audio signals having predetermined essentially periodic portions and said portions where deletion has occurred are specified by said instruction signals as lying in the range from about $\frac{1}{4}$ to about $\frac{3}{4}$ of each of the essentially periodic portions, and wherein said step (b) of inserting is performed during fractional portions of each of said periodic portions lying in said range as specified by said instruction signals.

21. The method of claim 20 wherein said audio signals are speech signals and said essentially periodic portions correspond to the pitch periods of said speech signals.

22. The method of claim 20 wherein said portions where deletion has occurred comprise $\frac{1}{2}$ of each of said essentially periodic portions, and wherein said step (b) of inserting is performed during $\frac{1}{2}$ of each of said essentially periodic portions.

23. The method of claim 16 wherein said original signals are audio signals having phonemes and phoneme groups and wherein said compressed information signals are of a type previously compressed by the additional technique of deleting preselected signals representative of portions of particular phonemes and phoneme groups, said preselected signals corresponding to those portions lying between every nth pitch period of said particular phonemes and phoneme groups, said instruction signals further identifying said particular phoneme and phoneme groups and the corresponding values of n, and wherein said step (a) of reproducing includes the step of sequentially repeating each non-deleted signal representative of said particular phonemes and phoneme groups a number of times equal to the corresponding value of n specified by the identifying instruction signal.

24. The method of claim 16 wherein said information signals are of a type previously compressed by the additional technique of separating said original audio signals into at least two parts and deleting parts occurring later in time which are substantially identical to parts occurring earlier in time, said instruction signals specifying those parts so deleted, and wherein said step (a) of reproducing includes the step of repeating the non-deleted parts specified by said instruction signals.

25. A system for X period zeroing information bearing input signals to reduce the information content thereof without destroying the intelligibility thereof, said system comprising:

input means adapted to receive said input signals;

means coupled to said input means for deleting preselected relatively low-power portions of said input signals irrespective of polarity;

means coupled to said deleting means for generating instruction signals specifying those portions of said input signals deleted by said deleting means to be later replaced by a constant amplitude signal of predetermined value when synthesizing said information bearing signals, the value of each said constant amplitude signal lying between the maximum and minimum values of the corresponding deleted portions of the information bearing signal.

26. The combination of claim 25 wherein said input signals are essentially periodic and wherein said preselected portions lie in the range from about $\frac{1}{2}$ to about $\frac{3}{4}$ of the period.

27. The combination of claim 26 wherein said preselected portion is substantially $\frac{1}{2}$.

28. The combination of claim 26 wherein said input signals are speech signals and wherein said period comprises the pitch period of said speech signals.

29. The combination of claim 25 further including means coupled to said input means for time quantizing said input signals.

30. The combination of claim 25 further including means coupled to said deleting means for time quantizing the signals output therefrom.

31. The combination of claim 25 further including means coupled to said input means for time differentiating said signals.

32. The combination of claim 25 further including means coupled to said deleting means for time differentiating said signals output therefrom.

33. The combination of claim 25 wherein said input signals are audio signals having phonemes and phoneme groups and wherein said deleting means includes means for deleting preselected signals representative of portions of particular phonemes and phoneme groups from said audio signals, said preselected signals corresponding to parts of the pitch periods of said particular phonemes and phoneme groups, and wherein said means for generating includes means for generating additional instruction signals identifying the phonemes and phoneme groups so selected.

34. The combination of claim 25 wherein said input signals are audio signals having phonemes and phoneme groups and wherein said means for deleting includes means for deleting preselected signals representative of portions of particular phonemes and phoneme groups from said audio signals, said preselected signals corresponding to those portions lying between every nth pitch period of said particular phonemes and phoneme groups, and wherein said means for generating includes means for generating additional instruction signals specifying said particular phonemes and phoneme groups and identifying the corresponding values of n.

35. The combination of claim 25 wherein said means for deleting includes means for deleting parts of said input signals occurring later in time which are substantially identical to parts occurring earlier in time, and wherein said generating means includes means for generating further instruction signals specifying those parts so deleted.

36. The combination of claim 25 further including means coupled to said deleting means for delta-modulating the signals output therefrom.

37. The combination of claim 25 further including means coupled to said deleting means and said generating means for storing the signals output therefrom.

38. The combination of claim 37 further including means coupled to said deleting means and said generating means for converting the signals output therefrom to digital form.

39. The combination of claim 37 wherein said input signals are speech signals and wherein said storing means includes means for storing portions of said signals output from said deleting means corresponding to selected phonemes and phoneme groups according to their ability to blend naturally with any other phoneme.

40. A system for synthesizing audio signals from information signals previously compressed from original signals by the technique of X period zeroing said original signals by deleting predetermined relatively low-power information bearing portions therefrom and having non-deleted portions, and instruction signals identifying those portions of the compressed information signals where deletion has occurred, said system comprising:

means for reproducing said compressed information signals;

means for inserting substantially constant amplitude signals between said non-deleted portions of said compressed informaton signals in accordance with said instruction signals, each said substantially constant amplitude signal having a single value lying between the maximum and minimum values of the corresponding deleted portion of the original signal, so that said deleted relatively low-power signal portions are replaced by said signals of substantially constant amplitude; and means for converting the signals output from said inserting means to audible form.

41. The combination of claim 40 further including memory means for storing said compressed signals and wherein said means for reproducing includes means for reading said signals from said memory means.

42. The combination of claim 41 wherein said memory means comprises a digital memory device for storing said compressed signals in digital form, and wherein said reproducing means includes means for converting said compressed signals from said digital form to analog signals.

43. The combination of claim 40 wherein said compressed information signals are delta-modulated signals, and wherein said reproducing means includes means for delta-modulation decoding said compressed information signals.

44. The combination of claim 40 wherein said compressed information signals represent audio signals having predetermined essentially periodic portions and said portions where deletion has occurred are specified by said instruction signals as lying in the range from about $\frac{1}{4}$ to about $\frac{3}{4}$ of each of the essentially periodic portions, and wherein said inserting means includes means for inserting said constant amplitude signals during fractional portions of each of said periodic portions lying in said range as specified by said instruction signals.

45. The combination of claim 44 wherein said audio signals are speech signals and said essentially periodic portions correspond to the pitch periods of said speech signals.

46. The combination of claim 44 wherein said portions where deletion has occurred comprise $\frac{1}{2}$ of each of said essentially periodic portions, and wherein said inserting means includes means for inserting said constant amplitude signals during $\frac{1}{2}$ of each of said essentially periodic portions.

47. The combination of claim 40 wherein said information signals are of a type previously compressed by the additional technique of deleting selected portions of said original audio signals corresponding to particular phonemes and phoneme groups, said selected portions lying between every nth pitch period of the corresponding phoneme and phoneme group, said instruction signals further identifying the particular phonemes and phoneme groups and the corresponding values of n, and wherein said reproducing means includes means for sequentially repeating each of said selected portions of said compressed information signals corresponding to said particular phonemes and phoneme groups a number of times equal to the corresponding value of n specified by the identifying instruction signal.

48. The combination of claim 40 wherein said information signals are of a type previously compressed by the additional technique of separating said original audio signals into at least two parts and deleting parts occurring later in time which are substantially identical to parts occurring earlier in time, said instruction signals specifying those parts so deleted, and wherein said reproducing means includes means for repeating the non-deleted parts specified by said instruction signals.

49. A method of processing information bearing signals to initially reduce the information content thereof without destroying the intelligibility of the information contained therein and to synthesize signals from the processed signals, said method comprising the steps of:

(a) X period zeroing said information bearing signals by deleting preselected relatively low-power portions thereof irrespective of polarity;

(b) generating instruction signals specifying those portions of said signals deleted in step (a) to be replaced by a substantially constant amplitude signal of predetermined value;

(c) reproducing the signals resulting from said step (a) of deleting;

(d) inserting said substantially constant amplitude signals between the non-deleted portions of said reproduced information signals in accordance with said instruction signals, each said substantially constant amplitude signal having a single value lying between the maximum and minimum values of the corresponding deleted portion of the original signal, so that said deleted relatively low-power signal portions are replaced by said signals of substantially constant amplitude; and (e) converting the signals resulting from step (d) to perceivable form.

50. The method of claim 49 wherein said information bearing signals are essentially periodic and wherein said preselected relatively low-power portions lie in the range from about $\frac{1}{4}$ to about 182 of the period.

51. The method of claim 50 wherein said information bearing signals are speech signals and wherein said period comprises the pitch period of said speech signals.

52. The method of claim 50 wherein said preselected portion is substantially $\frac{1}{2}$.

53. The method of claim 49 further including the step of storing in a memory device the signals resulting from said steps of (a) X period zeroing, and (b) generating.

54. The method of claim 53 wherein said step of storing is preceded by the step of converting said signals resulting from said steps of (a) X period zeroing, and (b) generating to digital signals.

55. The method of claim 49 wherein said information bearing signals comprise audio-electrical signals.

56. The method of claim 49 wherein said signals resulting from said steps of (a) X period zeroing, and (b) generating are stored in a memory device, and wherein said step (c) of reproducing includes the step of reading said stored signals from said memory device.

57. The method of claim 56 wherein said stored signals are stored in said memory device in digital form, and wherein said step (c) of reproducing includes the step of converting said digital signals to analog signals.

58. The method of claim 49 wherein said signals resulting from said steps of (a) X period zeroing, and (b) generating are delta-modulated signals, and wherein said step (c) of reproducing includes the steps of delta-modulation decoding said resulting signals.

59. A system for processing information bearing input signals to initially compress said input signals by reducing the information content thereof without destroying the intelligibility thereof and subsequently synthesizing signals from said compressed signals, said system comprising:

input means adapted to receive said input signals;

means coupled to said input means for X period zeroing said input signals, said X period zeroing means including means for deleting preselected relatively low-power portions of said input signals irrespective of polarity;

means coupled to said deleting means for generating instruction signals specifying those portions of said input signals deleted by said deleting means;

means for reproducing said information signals;

means for inserting substantially constant amplitude signals between the non-deleted portions of the signals generated by said reproducing means in accordance with said instruction signals, each said substantially constant amplitude signal having a single value lying between the maximum and minimum values of the corresponding deleted portion of the input signals, so that said deleted relatively low-power signal portions are replaced by said signals of substantially constant amplitude; and means for converting the signals output from said inserting means to perceivable form.

60. The combination of claim 59 wherein said input signals are essentially periodic and wherein said preselected portions lie in the range from about $\frac{1}{4}$ to about 182 of the period.

61. The combination of claim 60 wherein said preselected portion is substantially $\frac{1}{2}$.

62. The combination of claim 60 wherein said input signals are speech signals and wherein said period comprises the pitch period of said speech signals.

63. The combination of claim 59 further including means coupled to said deleting means for delta modulating the signals output therefrom.

64. The combination of claim 59 further including means coupled to said deleting means and said generating means for storing the signals output therefrom.

65. The combination of claim 64 further including means coupled to said deleting means and said generating means for converting the signals output therefrom to digital form.

66. The combination of claim 63 wherein said reproducing means includes means for delta-modulation decoding said compressed information signals.

67. For use with a memory element containing compressed information time domain signals produced by predetermined signal compression techniques and instruction signals specifying the particular compression techniques applied to original information bearing time domain signals to produce corresponding portions of said compressed information time domain signals, said predetermined signal compression techniques including X period zeroing of said original information bearing time domain signals by deleting preselected relatively low-power portions thereof and generating instruction signals specifying those portions of the deleted signals to be replaced by a substantially constant amplitude signal of predetermined value, a controller device for synthesizing said original information bearing time domain signals, said controller device comprising:

controller storage means having an input adapted to be coupled to said memory element for sequentially receiving ordered ones of said compressed information time domain signals;

means adapted to be coupled to said controller storage means for generating control signals enabling said ordered ones of said compressed information time domain signals to be coupled to said controller storage means, said control signal generating means including means for receiving corresponding ones of said instruction signals identifying the type of compression technique applied to said ordered ones of said compressed information time domain signals associated with said control signals;

converter means coupled to said controller storage means for converting said ordered ones of said compressed information time domain signals to synthetic analog signals corresponding to said original information bearing time domain signals; and means responsive to receipt of an X period zero instruction signal from said memory element for causing said converter means to output a substantially constant amplitude signal having a single value lying between the maximum and minimum values of the corresponding deleted portion of the original information bearing time domain signals as a portion of the synthetic analog signal generated thereby.

68. The combination of claim 67 wherein said compressed signals and said instruction signals are digital characters, said controller storage means comprises a digital storage device, and said converter means includes digital-to-analog converter means for converting ordered ones of said compressed information time domain digital characters to said synthetic analog signals.

69. The combination of claim 67 wherein said predetermined signal compression techniques include delta modulation of said original information bearing time domain signals, and wherein said controller device further includes means coupled to said controller storage means for delta demodulating signals appearing at the output thereof, when enabled, and means coupled to said delta demodulating means and responsive to the receipt by said control means of a delta modulation instruction signal from said memory element for enabling said delta demodulating means to delta demodulate the ordered ones of said compressed information signals corresponding to said delta demodulation instruction signal.

* * * * *